US005787792A

United States Patent [19]

Illgner

[11] Patent Number: 5,787,792

[45] Date of Patent: Aug. 4, 1998

[54] HYDRAULICALLY ACTUATED LOCKING ELEMENT WITH TWO LOCKING BOLTS AXIALLY SLIDABLE ON AN AXIS

[75] Inventor: Eberhard Illgner, Nieder-Olm, Germany

[73] Assignee: Man Technologie AG, Augsburg, Germany

[21] Appl. No.: 788,543

[22] Filed: Jan. 24, 1997

[30] Foreign Application Priority Data

Jan. 25, 1996 [DE] Germany ..... 296 01 240 U

[51] Int. Cl.[6] ..... F01B 15/02

[52] U.S. Cl. ..... 92/117 A; 92/117 R

[58] Field of Search ..... 92/117 R, 117 A, 92/151, 150

[56] References Cited

U.S. PATENT DOCUMENTS

| | | | |
|---|---|---|---|
| 4,003,219 | 1/1977 | Stull | 92/117 A X |
| 4,020,745 | 5/1977 | Iijima et al. | 92/117 R X |
| 4,539,893 | 9/1985 | Zingl | 92/117 A X |
| 4,608,876 | 9/1986 | Rosell | 92/117 A X |
| 4,796,514 | 1/1989 | Richter | 92/150 X |
| 5,014,602 | 5/1991 | Iwata | 92/117 A |
| 5,061,078 | 10/1991 | Yada | 92/117 A X |

*Primary Examiner*—Hoang Nguyen
*Attorney, Agent, or Firm*—McGlew and Tuttle

[57] ABSTRACT

A hydraulically actuated locking element with two locking bolts axially displaceable on an axis. A carrying structure is provided with two, slidingly guided hydraulic cylinders, two cylinder bottoms, which act as locking bolts and are designed as force-transmitting cylinder bottom. A centrally fastened, common piston rod of the hydraulic cylinders is provided with a stationary piston at each piston rod end. A centrally rigidly connected piston rod fastening is arranged in the carrying structure and between the two, sliding hydraulic cylinders. The piston rod fastening and the piston rod are provided with holes for guiding hydraulic oil.

2 Claims, 2 Drawing Sheets

HYDRAULICALLY ACTUATED LOCKING ELEMENT WITH TWO LOCKING BOLTS AXIALLY SLIDABLE ON AN AXIS

FIELD OF THE INVENTION

The present invention pertains to a hydraulically actuated locking element with two locking bolts displaceable axially on an axis.

BACKGROUND OF THE INVENTION

It was found that in hydraulically actuated locking elements designed to date with piston rods designed as locking bars, the seals may become untight due to locking forces which occur.

SUMMARY AND OBJECTS OF THE INVENTION

The primary object of the present invention is therefore to eliminate this drawback of the seals becoming untight due to locking forces which occur.

This drawback is eliminated according to the present invention in a hydraulically actuated locking element with two locking bolts axially displaceable on an axis. A carrying structure is provided with two, slidingly guided hydraulic cylinders, two cylinder bottoms, which act as locking bolts and are designed as force-transmitting cylinder bottom. A centrally fastened, common piston rod of the hydraulic cylinders is provided with a stationary piston at each piston rod end. A, centrally rigidly connected piston rod fastening is arranged in the carrying structure and between the two, sliding hydraulic cylinders. The piston rod fastening and the piston rod are provided with holes for guiding hydraulic oil.

The hydraulically actuated locking element according to the invention is preferably provided with the common piston rod composed of two said halves. Each half is fastened to the piston rod fastening and the pistons.

The advantages achieved by the present invention consist essentially in that the locking bolt, designed as the cylinder bottom of the two axially displaceable, slidingly mounted hydraulic cylinders, transmits the locking forces directly to the carrying structure, without these forces being passed on via seals.

Furthermore, provisions are made according to an embodiment of the present invention for the two axially displaceable, slidingly mounted hydraulic cylinders having a common, stationary piston rod with one piston each at the piston rod ends. The common piston rod is rigidly connected to the carrying structure in the middle.

The design according to the present invention, in which the slidingly mounted hydraulic cylinders are embedded in the carrying structure, leads to the advantage that these cylinders are adequately protected during rough operation.

Furthermore, provisions are made according to the present invention for the stationary, common piston rod and the piston rod fastening having at least two holes each for guiding the hydraulic oil. Guiding the hydraulic oil centrally corresponds to the subject of the invention.

It is achieved due to the design of the central hydraulic oil guide that only two hydraulic oil lines are needed for actuating the locking bolts.

Advantages are also provided by the embodiment of the locking element wherein the common piston rod comprises two halves. Each half is arranged between the piston rod fastening and the pistons.

The device of present invention has numerous possible applications. Thus, the present invention may be used, among other things, in so-called bridge-laying vehicles, i.e., vehicles for laying bridge sections of a collapsible bridge. Bridge sections can be locked there on the laying arm of the vehicle with the locking elements according to the present invention.

In hydraulic engineering, weir levers can be locked by means of the device according to the present invention.

The present invention will be described in detail below on the basis of an exemplary embodiment.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
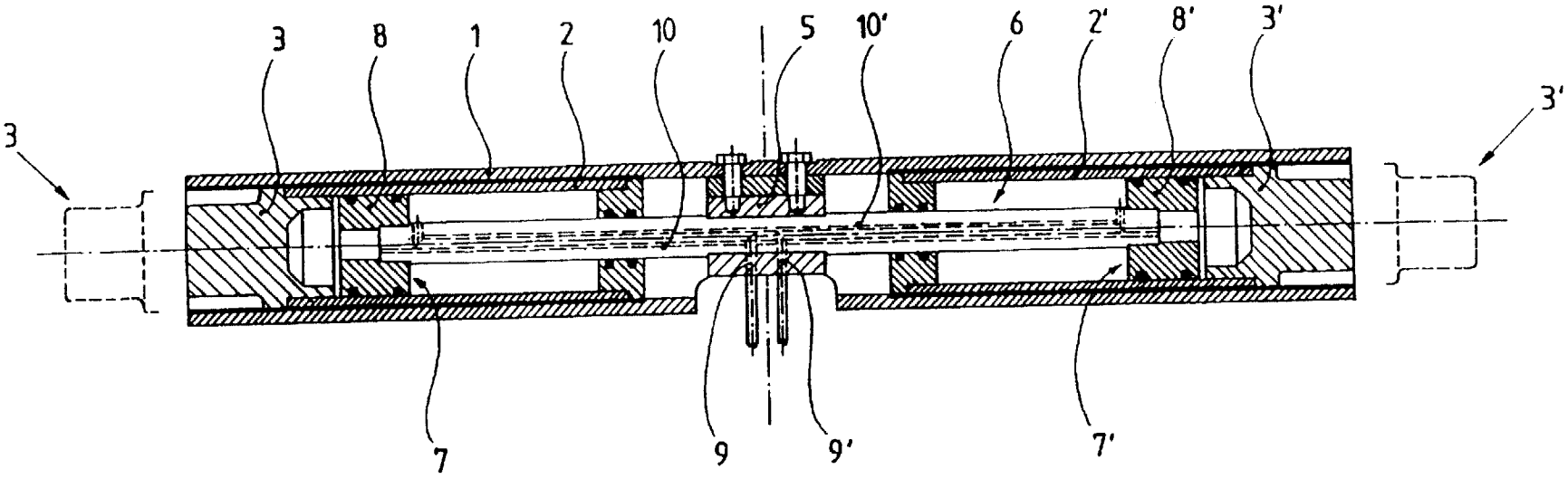
FIG. 1 is a sectional view of a hydraulically actuated locking element according to an embodiment of the invention.

Referring to the drawings in particular, the invention comprises a hydraulically actuated locking element as shown in FIG. 1 including a carrying structure 1 with two hydraulic cylinders 2, 2', which are slidingly guided on an axis and have two cylinder bottoms, which act as locking bolts 3, 3' and have a force-transmitting design.

A piston rod fastening element 5 is arranged centrally, rigidly connected to the carrying structure 1, arranged between the two sliding hydraulic cylinders 2, 2'.

The two hydraulic cylinders 2, 2' have a common piston rod 6 with a piston 8, 8' at the two piston rod ends 7, 7'.

This common piston rod 6 is centrally rigidly connected to the piston rod fastening element 5. The piston rod fastening element 5 and the piston rod 6 have at least two holes 9, 9' and 10, 10' for guiding the hydraulic oil.

Figure 2:
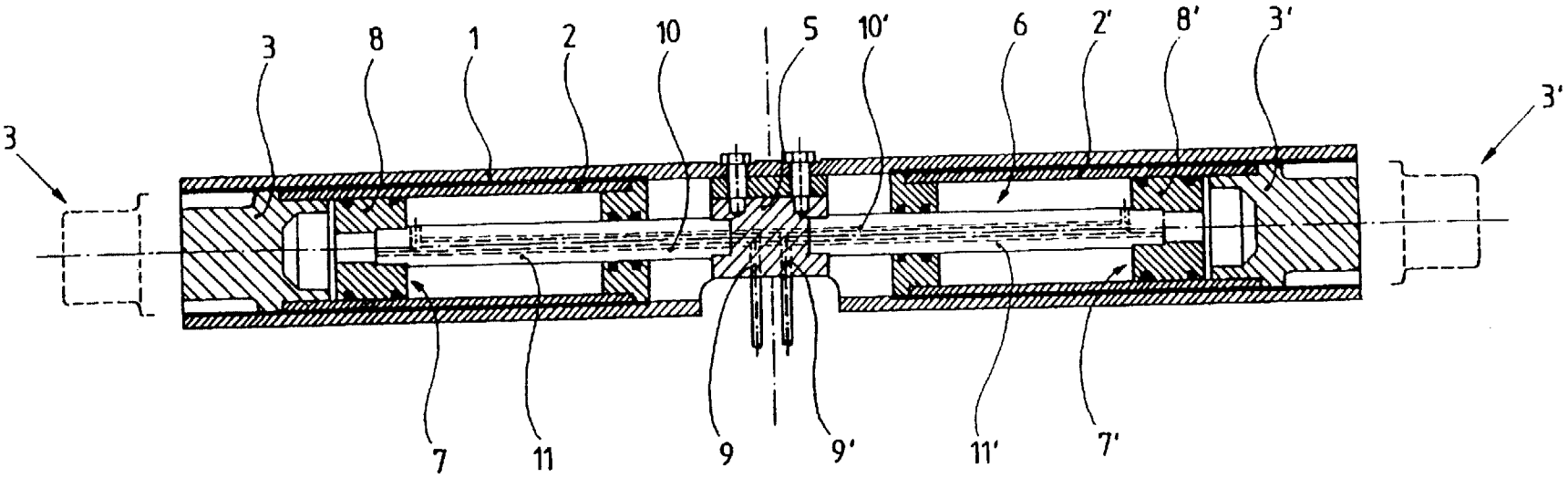
FIG. 2 is a sectional view of a hydraulically actuated locking element according to another embodiment of the invention.

FIG. 2 shows a hydraulically actuated locking element as shown in FIG. 1, but with a common piston rod 6, which is composed of two halves 11, 11'. Each half 11, 11' is arranged between the piston rod fastening 5 and the pistons 8, 8'.

While specific embodiments of the invention have been shown and described in detail to illustrate the application of the principles of the invention, it will be understood that the invention may be embodied otherwise without departing from such principles.

What is claimed is:

1. A hydraulically actuated locking element, comprising:

a carrying structure with two, slidingly guided hydraulic cylinders two locking bolts axially displaceable on an axis, said two locking bolts comprising two cylinder bottoms designed as force-transmitting cylinder bottoms;

a centrally fastened common piston rod disposed in said hydraulic cylinders;

a stationary piston at each end of said piston rod;

a centrally rigidly connected piston rod fastening element arranged in said carrying structure and between said, sliding hydraulic cylinders, said piston rod fastening element and said piston rod being provided with holes for guiding hydraulic fluid.

2. A hydraulically actuated locking element in accordance with claim 1, wherein said common piston rod includes two piston rod halves wherein each of said halves is fastened to said piston rod fastening element and said pistons.

* * * * *